US009672773B2

(12) United States Patent
Zhang et al.

(10) Patent No.: US 9,672,773 B2
(45) Date of Patent: Jun. 6, 2017

(54) METHOD FOR ADJUSTING GAMMA VOLTAGES OF OLED DISPLAY DEVICE

(71) Applicant: BOE TECHNOLOGY GROUP CO., LTD., Beijing (CN)

(72) Inventors: Chen Zhang, Beijing (CN); Fei Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 78 days.

(21) Appl. No.: 14/648,123

(22) PCT Filed: Sep. 26, 2014

(86) PCT No.: PCT/CN2014/087602

§ 371 (c)(1),
(2) Date: May 28, 2015

(87) PCT Pub. No.: WO2015/180337

PCT Pub. Date: Dec. 3, 2015

(65) Prior Publication Data

US 2016/0267842 A1 Sep. 15, 2016

(30) Foreign Application Priority Data

May 30, 2014 (CN) ..... 2014 1 0240555

(51) Int. Cl.
*G09G 3/3258* (2016.01)
*G09G 3/20* (2006.01)
(Continued)

(52) U.S. Cl.
CPC ..... *G09G 3/3258* (2013.01); *G09G 3/006* (2013.01); *G09G 3/2011* (2013.01);
(Continued)

(58) Field of Classification Search
CPC ..... G09G 2320/045; G09G 2320/0633; G09G 2320/0673; G09G 2330/12;
(Continued)

(56) References Cited

U.S. PATENT DOCUMENTS

2002/0047550 A1 4/2002 Tanada
2005/0030267 A1* 2/2005 Tanghe ..... G09G 3/3216 345/82

(Continued)

FOREIGN PATENT DOCUMENTS

CN 1595486 A 3/2005
CN 101290744 A 10/2008

(Continued)

OTHER PUBLICATIONS

International Search Report dated Feb. 17, 2015; PCT/CN2014/087602.

(Continued)

*Primary Examiner* — Dmitriy Bolotin
(74) *Attorney, Agent, or Firm* — Ladas & Parry LLP

(57) ABSTRACT

A method for adjusting a gamma voltage of an OLED display device, including; acquiring a test picture pre-stored in the OLED display device, and extracting a first piece of data information on the test picture; comparing the first piece of data information with a pre-stored second piece of data information on the test picture before the OLED display device is aged, analyzing a comparison result, and obtaining the aging coefficient of the OLED display device; acquiring a set of gamma voltage values corresponding to the aging coefficient, outputting the set of gamma voltage values to a gamma integrated circuit of the OLED display device, and completing the adjustment of the gamma voltage.

11 Claims, 3 Drawing Sheets

(51) Int. Cl.
*G09G 3/3233* (2016.01)
*G09G 3/00* (2006.01)

(52) U.S. Cl.
CPC ... *G09G 3/3233* (2013.01); *G09G 2320/0295* (2013.01); *G09G 2320/045* (2013.01); *G09G 2320/0633* (2013.01); *G09G 2320/0673* (2013.01); *G09G 2320/0693* (2013.01); *G09G 2330/12* (2013.01); *G09G 2360/145* (2013.01)

(58) Field of Classification Search
CPC .. G09G 2360/145; G09G 3/2011; G09G 3/32; G09G 3/3233; G09G 3/3258; G09G 3/006; G09G 2320/0295; G09G 2320/0693
See application file for complete search history.

(56) References Cited

U.S. PATENT DOCUMENTS

2014/0267372 A1* 9/2014 Chaji ..... G06T 3/403 345/606
2015/0317928 A1* 11/2015 Safaee-Rad ..... G09G 3/2003 345/593
2015/0317944 A1* 11/2015 Safaee-Rad ..... G09G 5/02 345/595

FOREIGN PATENT DOCUMENTS

| | | | |
|---|---|---|---|
| CN | 102426816 | A | 4/2012 |
| CN | 103280188 | A | 9/2013 |
| CN | 104021760 | A | 9/2014 |
| JP | 2006-284970 | A | 10/2006 |
| JP | 2006-284971 | A | 10/2006 |

OTHER PUBLICATIONS

International Preliminary Report on Patentability 0issued Dec. 6, 2016; PCT/CN2014/087602.

* cited by examiner

METHOD FOR ADJUSTING GAMMA VOLTAGES OF OLED DISPLAY DEVICE

TECHNICAL FIELD

The present disclosure relates to a method for adjusting gamma voltages of an OLED display device.

BACKGROUND

In the art of display technique, an Organic Light-Emitting Diode (OLED) display device has gained more attentions due to its features such as wide color gamut, wide view angle, thinness, lightness, low energy consumption, high response speed, high contrast, bendable capability and the like, and increasingly becomes one of main trends in the art of display technique.

In practical applications, a light-emitting material of the OLED display device would be aged gradually as the display time lapses, which results in a reduction of the light-emitting efficiency; affecting a display effect significantly. The solution to the above issue is mainly to adjust a gamma voltage so as to restore the display effect: that is, at present, those skilled in the art generally adopt a GAMMA 2.2 curve as a standard gamma curve, and adjust the gamma voltage so as to guarantee a consistency of the gamma curve of the OLED display device with the standard gamma curve.

Nevertheless, it is known to the inventors that there is only one set of gamma voltage data included in the OLED display device, and thus after the OLED device is aged, it is necessary to return the OLED device to the factory to adjust the gamma voltage. On the basis of this, to implement the adjustment of the gamma voltage, it needs to collect the luminance of an image by a luminance sampling apparatus, then convert the same to gray levels (i.e., gamma voltage values) by computation, and download the data to a Timer Control Register (TCON) integrated circuit; thus, the procedure of the adjustment is relatively complex. It can be seen that in the above method, when the gamma voltage of the OLED display device needs to be adjusted, it is necessary to return the OLED display device to the factory to perform the complex adjustment, which renders troubles and high cost for the customer in use and after-sales service.

SUMMARY

According to an embodiment of the present disclosure, there is provided a method for adjusting gamma voltages of an OLED display device, which is easily to be performed, so that a user can adjust the gamma voltage on his/her own without returning the OLED display device to the factory, thus reducing a maintenance cost effectively.

For the above purpose, the embodiments of the present disclosure adopts the following technical solutions.

There is provided a method for adjusting gamma voltages of an Organic Light-Emitting Diode (OLED) display device, comprising: acquiring a test picture pre-stored in the OLED display device, and extracting a first piece of data information on the test picture, wherein the first data information comprises a current parameter or an optical parameter; comparing the first piece of data information with a pre-stored second piece of data information on the test picture before the OLED display device is aged, analyzing a comparison result, and obtaining aging coefficient of the OLED display device, wherein the second piece of data information can comprise a current parameter or an optical parameter; acquiring a set of gamma voltage values corresponding to the aging coefficient, outputting the set of gamma voltage values to a gamma integrated circuit of the OLED display device, and completing an adjustment of the gamma voltage.

Optionally, acquiring the set of gamma voltage values corresponding to the aging coefficient comprises: acquiring one of N sets of gamma voltage values pre-stored in the OLED display device, corresponding to the aging coefficient, wherein a range from an average luminance value to the highest luminance as preset before the OLED display device is aged is divided into N parts equally, and N peak luminance points except the average luminance value are obtained; each of the N sets of gamma voltage values represents the voltage values corresponding to a range from 0 to each peak luminance point, respectively.

Optionally, acquiring the test picture pre-stored in the OLED display device and extracting the first piece of data information on the test picture comprises: controlling the OLED display device to play back the pre-stored test picture and extracting the first piece of data information on the test picture.

Further optionally, controlling the OLED display device to play back the pre-stored test picture comprises: controlling the OLED display device to enter into an adjustment mode, and to play back the pre-stored test picture repeatedly.

Optionally, the first piece of data information comprises an optical parameter; the optical parameter at least comprises a luminance and a saturation; extracting the first piece of data information on the test picture comprises: controlling a camera to collect the test picture, and extracting the first piece of data information on the collected test picture; wherein, the camera is connected to the OLED display device; the pre-stored second piece of data information on the test picture before the OLED display device is aged is the optical parameter of the test picture collected by the camera and extracted before the OLED display device is aged.

Further optionally, the test picture is stored in a memory chip of the OLED display device; and connecting the camera to the OLED display device comprises: connecting the camera to the memory chip of the OLED display device, so that the test picture collected by the camera is transmitted to the memory chip.

Further, extracting first piece of data information on the collected test picture comprises controlling an image analysis module of the OLED display device to extract the first piece of data information on the collected test picture.

Optionally, the first piece of data information comprise the current parameter; the extracting the first piece of data information on the test picture comprises: controlling a current extracting module of the OLED display device to extract the first piece of data information on the test picture; the pre-stored second piece of data information on the test picture before the OLED display device is aged is the current parameter of the test picture extracted by the current extracting module before the OLED display device is aged.

In an example, the image analysis module or the current extracting module is integrated into a core processing chip of the OLED display device.

An embodiment of the present disclosure provides a method fix adjusting gamma voltages of an OLED display device, the method comprises: acquiring a test picture pre-stored in the OLED display device, and extracting a first piece of data information on the test picture, wherein the first data information comprises a current parameter or an optical parameter; comparing the first piece of data information with a pre-stored second piece of data information on the test picture before the OLED display device is aged, analyzing a comparison result, and obtaining aging coefficient of the OLED display device, wherein the second piece of data information comprise a current parameter or an optical parameter; acquiring a set of gamma voltage values corresponding to the aging coefficient, outputting the set of gamma voltage values to a gamma integrated circuit of the OLED display device, and completing an adjustment of the gamma voltage.

In such a way, the adjustment of the gamma voltage can be realized as follows by: storing, inside the OLED display device, test pictures and the second piece of data information corresponding to the test pictures before the OLED display device is aged, acquiring the test pictures and the first piece of data information corresponding thereto after the OLED display device is aged, and comparing the first piece of data information with the second piece of data information and analyzing the comparison result, so as to obtain the aging coefficient of the OLED display device, selecting a set of gamma voltage values corresponding to the aging coefficient, and completing the adjustment of the gamma voltage. On the basis of this, the user only needs to control the OLED display device to acquire the test pictures or the test pictures are acquired automatically by the OLED display device, so that the first piece of data information on the test picture after the OLED display device is aged can be extracted, and the above adjustment procedure can be implemented entirely. It can be known that the method for adjusting the gamma voltages provided in the embodiment of the present disclosure is easily to be performed, and the user can adjust the gamma voltage on his/her own without returning the OLED display device to the factory, thus reducing the maintenance cost effectively.

BRIEF DESCRIPTION OF THE DRAWINGS

In order to illustrate embodiments of the present disclosure or the solution in the prior art more clearly, the figures which are required to describe the embodiments of the present disclosure or the technique as known by the inventor(s) are briefly introduced in the following. Obviously, the figures in the following description only relate to some embodiments of the present disclosure, and for those skilled in the art, other figures can be obtained on the basis of these figures without paying any creative labors.

REFERENCE SIGNS

10—gate line; 20—data line; 30—first transistor; 40—driving transistor; 50—light-emitting diode; 60—second transistor; 70—sensing line

DETAILED DESCRIPTION

Hereinafter, clear and complete descriptions will be given to implementations of the present disclosure with reference to accompanying drawings of the present disclosure. Obviously, the embodiments as described are only a part of the embodiments of the present invention, not all of the embodiments of the present invention. All other embodiments obtained by those skilled in the art on the basis of the embodiments of the present disclosure without paying any creative labor belong to the protection scope of the present disclosure.

Figure 1:
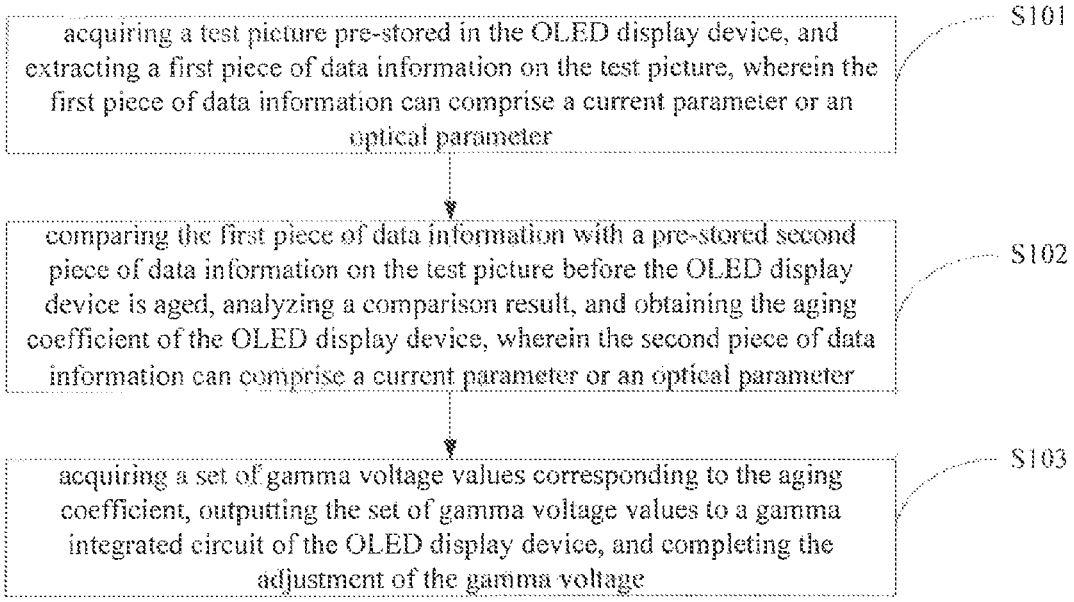
FIG. 1 illustrates a method for adjusting gamma voltages provided in an embodiment of the present disclosure.

There is provided a method for adjusting gamma voltages of an OLEO display device in an embodiment of the present disclosure, and as illustrated in FIG. 1, the method comprises:

S101, acquiring a test picture pre-stored in the OLED display device, and extracting a first piece of data information on the test picture, wherein the first piece of data information can comprise a current parameter or an optical parameter.

Herein, the test picture can be pre-stored in a memory chip of the OLED display device, and when it is needed to retrieve the test picture, the test picture can be extracted from the memory chip by a core processing chip of the OLED display device.

It should be noted that, firstly, the test picture can be pictures of Red (R), Green (G), Blue (B) and White (W) at different gray levels, and particularly, can be pictures of R, G, B and W at the highest gray level and those of R, G, B and W decreased at a step of a certain gray levels. Herein, the pictures of Red (R) at different gray levels refer to, for example, different pictures accordingly obtained in a case in which the values of G and B channels are both zero and the values of R channel are at different gray levels. Similarly, the pictures of Green (G) at different gray levels refer to, for example, different pictures accordingly obtained in a case in which the values of R and B channels are both zero and the values of G channel are at different gray levels, and the pictures of Blue (B) at different gray levels refer to, for example, different pictures accordingly obtained in a case in which the values of R and G channels are both zero and the values of B channel are at different gray levels. Further, the pictures of White color at different gray levels refer to, for example, different pictures accordingly obtained in a case in which the values of R, G and B channels are equal to each other and at respective gray levels. However, the embodiments of the present disclosure are not limited to this. For example, the OLED display device can display test pictures of red color at the highest gray level and decreased at a step of 32 gray levels in a range of 0-255 gray levels, and in particular, the test pictures of red color corresponding to the gray level 255, gray level 224, the gray level 192, the gray level 160, the gray level 128, the gray level 96, the gray level 64, and the gray level 32 respectively.

Secondly, the first piece of data information on the test picture as extracted can comprise particularly, the data information on the change of the OLED display device after it is aged which can be reflected by the test picture.

S102, comparing the first piece of data information with a pre-stored second piece of data information on the test picture before the OLED display device is aged, analyzing a comparison result, and obtaining the aging coefficient of the OLED display device, wherein the second piece of data information can comprise a current parameter or an optical parameter.

Herein, the pre-stored second piece of data information on the test picture before the OLED display device is aged, particularly can be the second piece of data information on the test picture as stored during a debugging phase after the OLED display device has been manufactured.

In particular, when the first piece of data information and the second piece of data information are compared and analyzed, the first piece of data information and the second piece of data information would comprise the piece of data information with the same type; that is, the first piece of data information and the second piece of data information can both comprise the optical parameter of the test picture, or the current parameter of the test picture.

Further, when the aging coefficient of the OLED display device is derived from the first piece of data information and the second piece of data information, the first and second piece of data information can be analyzed and processed by means of an aging analysis algorithm; wherein the aging analysis algorithm can be implemented by the core processing chip of the OLED display device.

S103, acquiring a set of gamma voltage values corresponding to the aging coefficient, outputting the set of gamma voltage values to a gamma integrated circuit of the OLED display device, and completing the adjustment of the gamma voltage.

It should be noted that, an aging degree of the OLED display device may vary with an operating time of the OLED display device; in view of this, during an implementation of the adjustment of the gamma voltage of the OLED display device, each of aging coefficients corresponds to a set of gamma voltage values, and thus, when the respective coefficient is obtained, the corresponding set of gamma voltage values can be obtained from the aging coefficient, so as to achieve an automatic adjustment of the gamma voltage.

Further, in the embodiment of the present disclosure, the adjustment procedure of the gamma voltage can be controlled by the core processing chip of the OLED display device, and thus a plurality of functional modules can be integrated into the core processing chip; naturally, an cooperation of other functional means might be required during the procedure of the specific implementation, for example, the memory chip of the OLED display device is required to store the test pictures.

The embodiment of the present disclosure provides a method for adjusting the gamma voltage of the OLED display device, wherein the method comprises: acquiring a test picture pre-stored in the OLED display device, and extracting a first piece of data information on the test picture, wherein the first piece of data information can comprise a current parameter or an optical parameter; comparing the first piece of data information with a pre-stored second piece of data information on the test picture before the OLED display device is aged, analyzing the comparison result, and obtaining the aging coefficient of the OLED display device, wherein the second piece of data information can comprise a current parameter or an optical parameter; acquiring a set of gamma voltage values corresponding to the aging coefficient, outputting the set of gamma voltage values to a gamma integrated circuit of the OLED display device, and completing the adjustment of the gamma voltage.

In such a way, the adjustment of the gamma voltage can be realized as follows by: storing, inside the OLED display device, test pictures and the second piece of data information corresponding to the test pictures before the OLED display device is aged, acquiring the test pictures and the first piece of data information corresponding thereto after the OLED display device is aged, and comparing the first piece of data information with the second piece of data information and analyzing the comparison result, so as to obtain the aging coefficient of the OLED display device, selecting a set of gamma voltage values corresponding to the aging coefficient, and completing the adjustment of the gamma voltage.

On the basis of this, the user only needs to control the OLED display device to acquire the test pictures or the test pictures are acquired automatically by the OLED display device, so that the first piece of data information on the test pictures can be extracted after the OLED display device is aged, and the above adjustment procedure can be implemented entirely. It can be known that the method for adjusting the gamma voltage provided in the embodiment of the present disclosure is easily to be performed, and the user can adjust the gamma voltage on his/her owner, without returning the OLED display device to the factory, thus reducing the maintenance cost effectively.

In view of this, in an example, acquiring a set of gamma voltage values corresponding to the aging coefficient can particularly comprise: acquiring one of N sets of gamma voltage values pre-stored in the OLED display device, corresponding to the aging coefficient, wherein in the N sets of gamma voltage values, the acquired one set of gamma voltage values is one set of gamma voltage values obtained according to the standard gamma curve, which corresponds to the aging coefficient.

Figure 2:
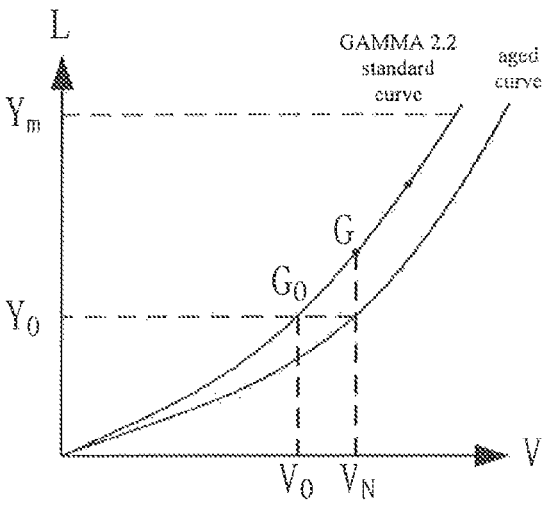
FIG. 2 illustrates gamma curves of an OLED display device before and after it is aged provided in an embodiment of the present disclosure.

On the basis of this, as illustrated in FIG. 2, the N sets of gamma voltage values can be designed as hallows: dividing a range from an average luminance value $Y_0$ to the highest luminance $Y_m$ as preset before the OLED display device is aged into N parts equally, and obtaining N peak luminance points except the average luminance value $Y_0$, wherein, the N peak luminance points comprises N−1 peak luminance isometric points and the highest luminance value $Y_m$, and the $i^{th}$ set of gamma voltage values among the N sets of gamma voltage values represents the voltage values corresponding to the range from 0 to the $i^{th}$ peak luminance point, $1<i<N$.

It should be noted that the gamma curve before the OLED device is aged is a curve which is subjected to the adjustment of gamma voltage, and thus the curve is well consistent with the standard gamma curve. Based on this, dividing the range from the average luminance value $Y_0$ to the highest luminance $Y_m$ as preset before the OLED display device is aged into the N parts equally, substantially means a division on the basis of the standard gamma curve.

Herein, the average luminance value $Y_0$ as preset before the OLED display device is aged refers to a average luminance which the OLED display device can achieve before it is aged, and it is lower than the highest luminance value $Y_m$.

Further, in a case in which the OLED display device is aged and needs the adjustment of gamma voltage, since the light-emitting efficiency of the light-emitting material decreases, and the luminance which can be achieved under a same voltage decreases, a higher voltage than that before it is aged is required to achieve the same luminance, in such a case, it is necessary to determine the voltage which is required to achieve the average luminance value $Y_0$ as preset before it is aged again, and then to select the voltage as the gamma voltage output value corresponding to the point (corresponding luminance) on the standard gamma curve.

It should be noted that, with reference to FIG. 2, although on the standard gamma curve it is illustrated that the luminances corresponding to the respective peak luminance points are higher than the average luminance value, in fact, after the OLED display device is aged, according to the different aging coefficients, the luminance actually displayed under the voltage (as $V_N$ illustrated in FIG. 2) corresponding to the peak luminance point (as the point G illustrated in FIG. 2) on the standard gamma curve, is the average luminance value $Y_0$ before it is aged.

On the basis of this, since there is a monotonic and one-to-one relationship between the gamma voltages and the gray levels, that is, there is a curve similar to the standard gamma curve between the gray level and the luminance, therefore during the procedure of the gamma voltage adjustment, the correspondence between the luminance and the gray level can be determined again. Taking 10 bits (1024 gray levels) as an example, it is possible to make the luminance of point 0 to those of respective peak luminance points correspond to the respective gray levels 0-1023. That is, the correspondence between the luminance and the gray level can be adjusted according to the actual situation, and it is realized that the data at all the gray levels (0-1023) are outputted by selecting different highest luminance peak values (herein, taking the luminance corresponding to each of peak luminance points as the re-determined highest luminance peak value), without a corresponding data conversion algorithm, thus a computation space is saved.

In the technique known to the inventor(s), the range from luminance value 0 to the highest luminance value $Y_m$ corresponds to the gray levels 0-1023, but the luminance values above the average luminance value $Y_0$ are seldom achieved in the actual application; that is, the higher gray levels corresponding to the range from the average luminance value $Y_0$ to the highest luminance value $Y_m$ are not used substantively, and thus such a range of higher gray levels is wasted; compared to this, in the embodiments of the present disclosure, each of the peak luminance points corresponds to the highest gray level depending on actual requirements, and it is achieved that data at all the gray levels is output, thus the display effect of the OLED display device is enhanced.

On the basis of this, optically, acquiring the test picture pre-stored in the OLED display device, and extracting the first piece of data information on the test picture can be implemented as follows: controlling the OLED display device to play hack the pre-stored test picture and extracting the first piece of data information on the test picture.

Herein, particularly, it can be as follows: the core processing chip controls the OLED display device to enter into an adjustment mode, and to play back the pre-stored test picture repeatedly, and further extracts the first piece of data information from the test picture; wherein, the test picture can be pre-stored in the memory chip; after entering the adjustment mode, the core processing chip can retrieve the test picture pre-stored in the memory chip and plays back the test picture repeatedly.

Under such a situation, in a case in which the first piece of data information comprises an optical parameter and the optical parameter in turn at least comprises luminance and saturation, extracting the first piece of data information on the test picture can be particularly as follows: controlling a camera to collect the test picture, and extracting the optical parameter of the collected test picture; wherein, the extracting the optical parameter of the collected test picture can be particularly as follows: controlling an image analysis module of the OLED display device to extract the optical parameter of the collected test picture.

Herein, the image analysis module can be integrated into the core processing chip of the OLEO display device.

The camera can be connected to the OLED display device, so that the core processing chip can extract and analyze the collected test picture.

Further, the camera can be connected to the memory chip of the OLED display device, so that the test picture collected by the camera can be transmitted to the memory chip, and the core processing chip can retrieve the test picture from the memory chip, extract and analyze the same.

Under such a situation, the second piece of data information on the test picture pre-stored before the OLED display device is aged can be the optical parameter of the test picture collected and extracted by the camera. Herein, the optical parameter of the test picture before the OLEO display device is aged can be recorded in a look-up table and saved in the core processing chip of the OILED display device; Of course, it can be saved in the memory chip.

Figure 3:
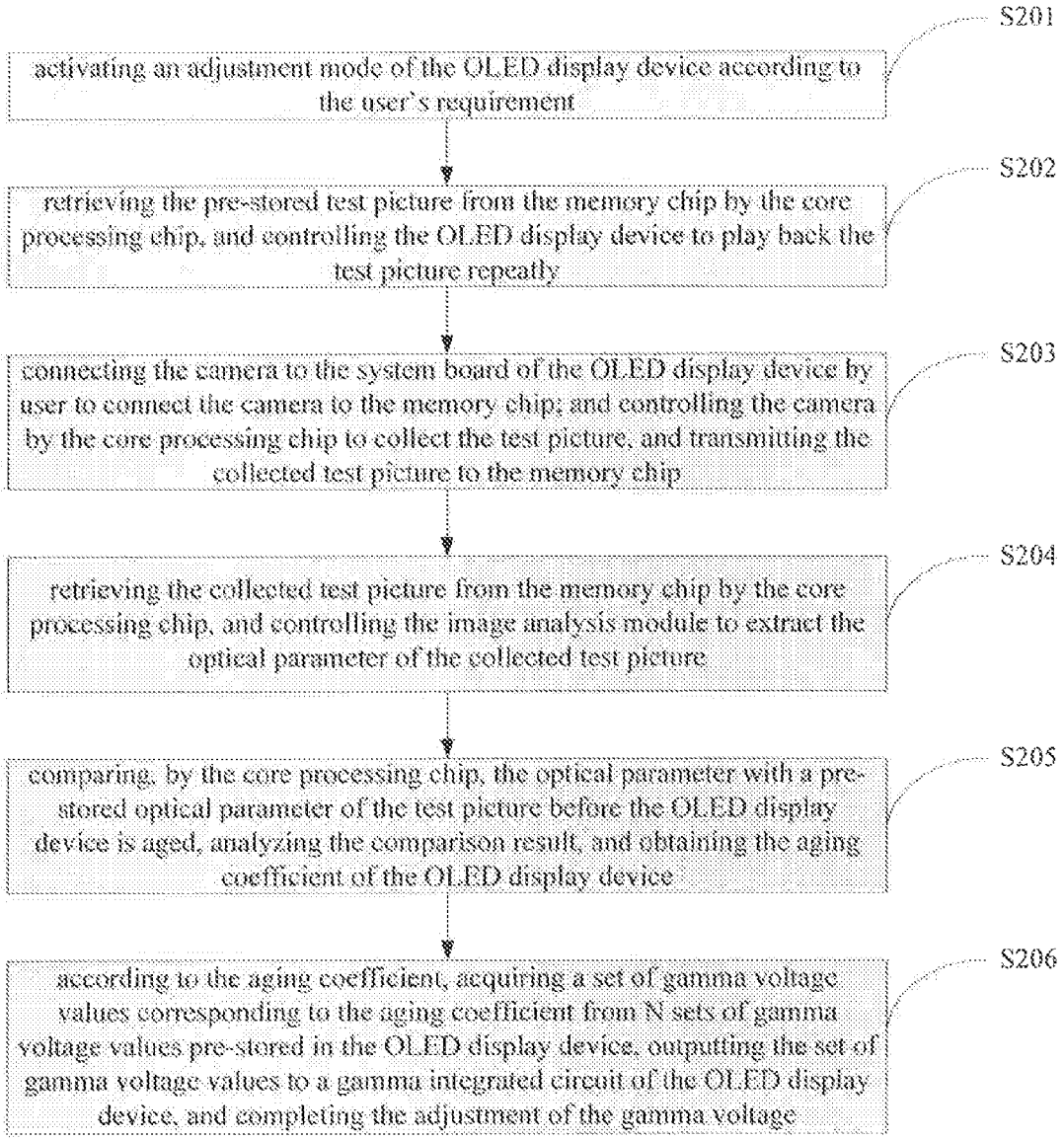
FIG. 3 is a first schematic diagram illustrating a process for adjusting the gamma voltage provided in an embodiment of the present disclosure.

It should be noted that no matter the pre-stored second piece of data information or the first piece of data information as acquired later, it needs to collect the test picture by the camera before and after the OLED display device is aged. On the basis of this, in an example of the embodiments of the present disclosure, the test pictures are collected by the same camera at the same orientation (comprising a distance relative to the display screen and a shooting angle) and the same shooting environment. In particular, the OLED display device can be equipped with a dedicated camera, with the optimum condition for use explained, so as to minimum the influence of other interfere factors As illustrated in FIG. 3, the above can be realized by the following steps:

S201, activating an adjustment mode of the OLED display device according to user's requirements;

S202, retrieving the pre-stored test picture from the memory chip by the core processing chip, and controlling the OLED display device to play back the test picture repeatedly;

wherein the test picture can comprise pictures of R, G, B and W at different gray levels, and particularly, the pictures of R, G, B and W varied at a step of 100 gray levels within 0-1023 gray levels;

S203, connecting the camera to the memory chip of the OLED display device by the user; and controlling the camera by the core processing chip to collect the test picture, and transmitting the collected test picture to the memory chip;

wherein the memory chip and the core processor chip are both arranged on a system board for achieving different functions;

S204, retrieving the collected test picture from the memory chip by the core processing chip, and controlling the image analysis module to extract the optical parameter of the collected test picture;

wherein the optical parameter at least comprise luminance and saturation;

S205, comparing, by the core processing chip, the optical parameter with a pre-stored optical parameter of the test picture before the OLED display device is aged, analyzing the comparison result, and obtaining the aging coefficient of the OLED display device;

S206, according to the aging coefficient, acquiring a set of gamma voltage values corresponding to the aging coefficient from N sets of gamma voltage values pre-stored in the OLED display device, outputting the set of gamma voltage values to a gamma integrated circuit of the OLED display device, and completing the adjustment of the gamma voltage.

By the steps of S201-S206, the adjustment for the gamma voltage of the OLED display device can be completed, so that the OLED display device can still maintain an excellent display effect even if it is aged; thus, the user can adjust the OLED display device on his/her own as required without returning the OLED display device to the factory, thus reducing the maintenance cost effectively.

It should be noted that as achieving the adjustment for gamma voltage by means of the above method, the user is required to activate the adjustment mode of the OLED display device, and connects the camera to the OLED display device.

In a case in which the first piece of data information is a current parameter, extracting the first piece of data information on the test picture can be particularly as follows: controlling a current extracting module of the OLED display device to extract the current parameter of the test picture.

Figure 4:
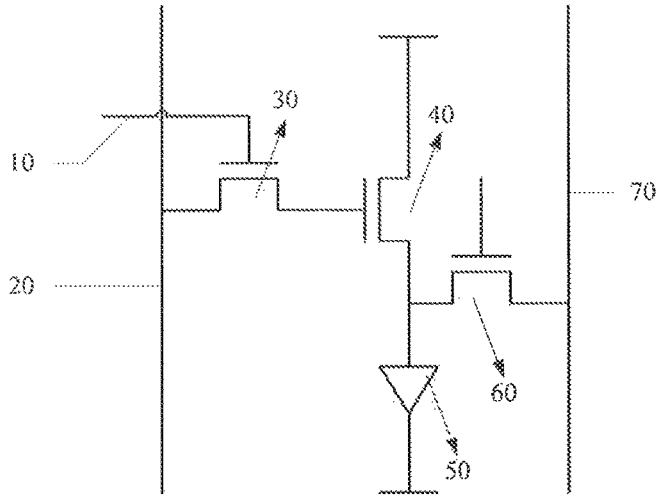
FIG. 4 is an equivalent circuit diagram of an OLED display device provided in an embodiment of the present disclosure.

In particular, FIG. 4 is an equivalent circuit diagram of each sub-pixel of the (RED display device, wherein each sub-pixel comprises a gate line 10 and a data line 20, a first transistor 30 as a switching transistor, a driving transistor 40, a light-emitting diode 50, a second transistor 60 and a sensing line 70.

On the basis of the above, extracting the current parameter of the test picture can be as follows: extracting the sensing current flowing through the sensing line 70. That is, before and after the OLED display device is aged, the sensing current flowing through the sensing line 70 would vary; the values of the sensing currents, flowing through the sensing line 70 respectively before and after the OLED display device is aged, are extracted as the current parameter of the first piece of data information and that of the second piece of data information respectively, and the aging coefficient of the OLED display device can be obtained by comparison and analysis on the current parameter of the first piece of data information and that of the second piece of data information.

Herein, the second piece of data information on the test picture pre-stored before the OLED display device is aged can be the sensing current through the sensing line 70 extracted by the current extracting module before the OLED display device is aged. Herein, the current parameter of the test picture before the OLED display device is aged can be recorded in the look-up table and saved in the core processing chip of the OLED display device. Herein, the current extracting module can be integrated into the core processing chip of the OLED display device.

When adjusting the gamma voltage by means of the embodiment of the present disclosure, the adjustment procedure can be achieved without connecting the OLED display to any external apparatus; based on this, in an example of the embodiment of the present disclosure, a regular automatic adjustment can be realized by setting a specific time interval; of course, the function of the regular automatic adjustment can be achieved by corresponding functional modules, and such functional modules can be integrated into the core processor chip.

It should be noted that, the current parameter of the test picture as extracted in the embodiment of the present disclosure is not limited to the sensing current in the OLED display device of the structure as illustrated in FIG. 4, and can be any current parameter in the OLED display device of other type, as long as the current parameter can reflect a variation of the current before and after the OLED display device is aged, and the aging coefficient of the OLED display device can be obtained according to the variation of the current.

Figure 5:
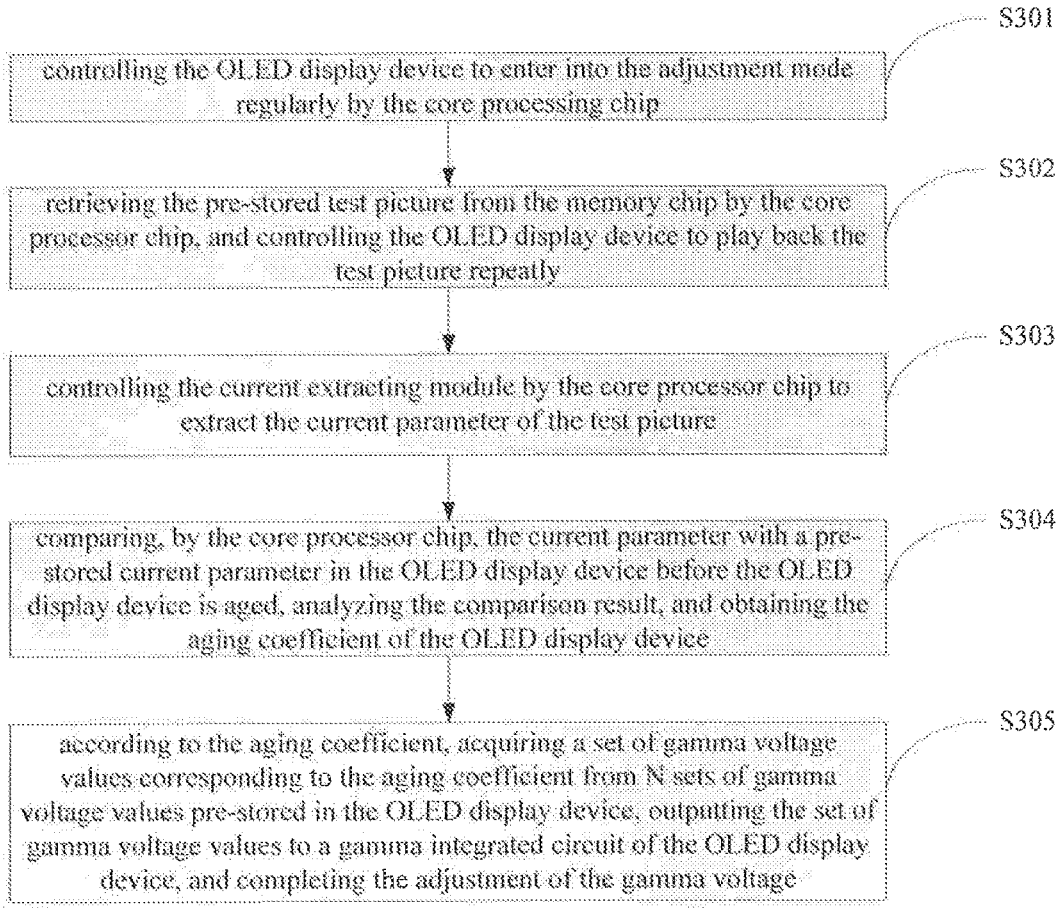
FIG. 5 is a second schematic diagram illustrating a process for adjusting the gamma voltage provided in an embodiment of the present disclosure.

The above implementation, as illustrated in FIG. 5, can be realized particularly by the following:

S301, controlling the OLED display device to enter into the adjustment mode regularly by the core processing chip;

S302, retrieving the pre-stored test picture from the memory chip by the core processing chip, and controlling the OLED display device to play back the test picture repeatedly;

wherein the test pictures can comprise pictures of R, G, B and W at different gray levels, and particularly, the pictures of R, G, B and W varied at a step of 100 gray levels within 0-1023 gray levels;

S303, controlling the current extracting module by the core processing chip to extract the current parameter of the test picture;

S304, comparing, by the core processor chip, the current parameter with the pre-stored current parameter in the OLED display device before the OLED display device is aged, analyzing the comparison result, and obtaining the aging coefficient of the OLED display device;

S305, according to the aging coefficient, acquiring a set of gamma voltage values corresponding to the aging coefficient from N sets of gamma voltage values pre-stored in the OLED display device, outputting the set of gamma voltage values to a gamma integrated circuit of the OLED display device, and completing the adjustment of the gamma voltage.

By the steps of S301-S305, the adjustment for the gamma voltage of the OLED display device can be completed, so that the OLED display device can still maintain an excellent display effect even if it is aged; thus, the adjustment for the OLED display device can be completed automatically without any user's operation, which can not only reduce the maintenance cost effectively, but also easily achieve the automatic adjustment for the gamma voltage at a plurality of times.

It should be noted that, when performing the adjustment for the gamma voltage, the display device can be adjusted as a whole simultaneously, or the display device can be divided into different pixel unit/sub-pixel units to perform adjustments thereon, and no limitation is made herein, the specific approach can be selected according to the actual situation and the user's requirement.

The above descriptions are only for illustrating the embodiments of the present disclosure, and in no way limit the scope of the present invention. It will be obvious that those skilled in the art may make modifications, variations and equivalences to the above embodiments without departing from the spirit and scope of the present invention as defined by the following claims. Such variations and modifications are intended to be included within the scope of the present invention. The protection scope of the present invention should be defined by the attached claims.

The present application claims the priority of a Chinese application filed on May 30, 2014, with No. 201410240555.3, and the disclosure of which is entirely incorporated herein by reference as a part of the present disclosure:

What is claimed is:

1. A method for adjusting gamma voltages of an Organic Light-Emitting Diode (OLED) display device, comprising:

acquiring a test picture pre-stored in the OLED display device, and extracting a first piece of data information on the test picture, wherein the first data information comprises a current parameter or an optical parameter;

comparing the first piece of data information with a pre-stored second piece of data information on the test picture before the OLED display device is aged, analyzing a comparison result, and obtaining an aging coefficient of the OLED display device, wherein the second piece of data information comprise a current parameter or an optical parameter;

acquiring a set of gamma voltage values corresponding to the aging coefficient, outputting the set of gamma voltage values to a gamma integrated circuit of the OLED display device, and completing an adjustment of the gamma voltage.

2. The method of claim 1, wherein acquiring the set of gamma voltage values corresponding to the aging coefficient comprises:

acquiring one of N sets of gamma voltage values pre-stored in the OLED display device, corresponding to the aging coefficient, wherein a range from an average luminance value to a highest luminance as preset before the OLED display device is aged is divided into N parts equally, and N peak luminance points except the average luminance value are obtained;

the $i^{th}$ set of gamma voltage values among the N sets of gamma voltage values are voltage values corresponding to a range from 0 to the $i^{th}$ peak luminance point.

3. The method of claim 2, wherein in each of the N sets of gamma voltage values, a current luminance peak value corresponds to a highest gray level.

4. The method of claim 1, wherein acquiring the test picture as pre-stored in the OLED display device and extracting the first piece of data information on the test picture comprises:

controlling the OLED display device to play back the pre-stored test picture and extracting the first piece of data information on the test picture.

5. The method of claim 4, wherein controlling the OLED display device to play back the pre-stored test picture comprises:

controlling the OLED display device to enter into an adjustment mode, and to play back the pre-stored test picture repeatedly.

6. The method of claim 4, wherein the first piece of data information comprises the optical parameter; the optical parameter comprises luminance and saturation;

extracting the first piece of data information on the test picture comprises:

controlling a camera to collect the test picture, and extracting the first piece of data information on the collected test picture; wherein, the camera is connected to the OLED display device;

the pre-stored second piece of data information on the test picture before the OLED display device is aged is the optical parameter of the test picture collected and extracted by the camera before the OLED display device is aged.

7. The method of claim 6, wherein the test picture is stored in a memory chip of the OLED display device;

connecting the camera to the OLED display device comprises: connecting the camera to the memory chip of the OLED display device, so that the test picture collected by the camera is transmitted to the memory chip.

8. The method of claim 6, wherein the extracting the first piece of data information on the collected test picture comprises:

controlling an image analysis module of the OLED display device to collect the first piece of data information on the collected test picture.

9. The method of claim 8, wherein the image analysis module is integrated into a core processor chip of the OLED display device.

10. The method of claim 4, wherein the first piece of data information comprise the current parameter;

extracting the first piece of data information on the test picture comprises:

controlling a current extracting module of the OLED display device to extract the first piece of data information on the test picture;

the pre-stored second piece of data information on the test picture before the OLED display device is aged is the current parameter of the test picture extracted by the current extracting module before the OLED display device is aged.

11. The method of claim 10, wherein the current extracting module is integrated into a core processor chip of the OLED display device.

* * * * *